United States Patent [19]

Hill

[11] Patent Number: 4,926,671

[45] Date of Patent: May 22, 1990

[54] PRESS BRAKE

[76] Inventor: James B. Hill, Rt. 2, P.O. Box 62, Galena, Mo. 65656

[21] Appl. No.: 279,866

[22] Filed: Dec. 5, 1988

[51] Int. Cl.[5] ..... B21J 9/18

[52] U.S. Cl. ..... 72/389; 72/450; 72/451; 72/453.03; 72/446; 100/272

[58] Field of Search ..... 72/389, 450, 451, 453.03; 100/271, 272, 280, 281, 286

[56] References Cited

U.S. PATENT DOCUMENTS

| | | | |
|---|---|---|---|
| 168,494 | 10/1875 | Hoffman et al. | 100/286 |
| 3,552,183 | 1/1971 | Heitmann | 72/450 |
| 3,570,300 | 3/1971 | Schulte | 72/451 |
| 3,763,689 | 10/1973 | Bridges | 72/451 |
| 4,013,003 | 3/1977 | Finsterwalder et al. | 100/286 |
| 4,070,896 | 1/1978 | Heitner | 72/389 |
| 4,131,189 | 12/1978 | Stephens | 72/389 |
| 4,170,124 | 10/1979 | MacGregor | 72/446 |
| 4,419,929 | 12/1983 | Dommer et al. | 100/286 |
| 4,590,784 | 5/1986 | Okabe et al. | 72/450 |
| 4,656,862 | 4/1987 | Kogure et al. | 72/389 |

FOREIGN PATENT DOCUMENTS

| | | | |
|---|---|---|---|
| 1363689 | 5/1964 | France | 100/286 |
| 0000418 | 1/1979 | Japan | 72/451 |
| 2045154 | 10/1980 | United Kingdom | 72/450 |

*Primary Examiner*—David Jones

[57] ABSTRACT

A brake press including a stationary bar, a translating bar, a disk rotatable about a fixed, stationary axis, a first set of linkage interconnecting one longitudinal end of the translating bar with the disk, and a second set of linkage interconnecting the other longitudinal end of the translating bar with the disk. The rotation of the disk in a first direction acts through both sets of linkage to translate the translating bar toward the stationary bar, and the rotation of the disk in a second direction acts through both sets of linkage to translate the translating bar away from the stationary bar. The disk may be selectively rotated in either direction or maintained in a stationary position by one or more hydraulic rams. The flow of hydraulic fluid to the hydraulic rams is controlled by a foot pedal which is biased in a position which will cause the hydraulic rams to rotate the disk so that the translating bar is moved away from the stationary bar.

15 Claims, 1 Drawing Sheet

PRESS BRAKE

BACKGROUND OF THE INVENTION

Press brakes are used to bend and otherwise deform metal objects such as metal pipes, tubes, bars, sheets, and plates. Press brakes conventionally possess a stationary metal bar and a parallel, translating bar adapted to move forcefully toward and away from the stationary bar. In order to move the translatable bar toward the stationary bar with sufficient force to deform metal disposed between the bars, one or more hydraulic rams are used to move the translatable bar. It is difficult to move the translatable bar evenly toward the stationary bar when the metal object to be deformed is disposed toward one end of the bars, since the degree of resistance would vary along the length of the translatable bar. Even though the force along the translatable bar might be uniform, when an opposing force of resistance varies along the length of the translatable bar, the translatable bar tends to tilt (i.e., become nonparallel) with respect to the stationary bar. The degree of tilt is difficult to predict and causes the metal object to be deformed in unpredictable, undesirable ways.

Various systems have been designed to try to maintain the translating bar in a parallel relation with the stationary bar, regardless of any variation in resistance along the length of the translatable bar. Such systems usually include sensors, hydraulic flow dividers, and metering devices adapted to modify the force applied along the length of the translatable bar to counteract the variation in resistance along the translatable bar. Most of these systems are complex and expensive and often still do not maintain the desired parallel relation of the two bars.

SUMMARY OF THE INVENTION

The present invention relates to a brake press including a stationary bar, a translating bar, a disk rotatable about a fixed, stationary axis, a first set of linkage interconnecting one longitudinal end of the translating bar with the disk, and a second set of linkage interconnecting the other longitudinal end of the translating bar with the disk. The rotation of the disk in a first direction acts through both sets of linkage to translate the translating bar toward the stationary bar, and the rotation of the disk in a second direction acts through both sets of linkage to translate the translating bar away from the stationary bar. The disk may be selectively rotated in either direction or maintained in a stationary position by one or more hydraulic rams. The flow of hydraulic fluid to the hydraulic rams is controlled by a foot pedal which is biased in a position which will cause the hydraulic rams to rotate the disk so that the translating bar is moved away from the stationary bar.

BRIEF DESCRIPTION OF THE DRAWING

The invention will be described with reference to the accompanying drawing wherein.

DESCRIPTION OF A PREFERRED EMBODIMENT

Figure 1:
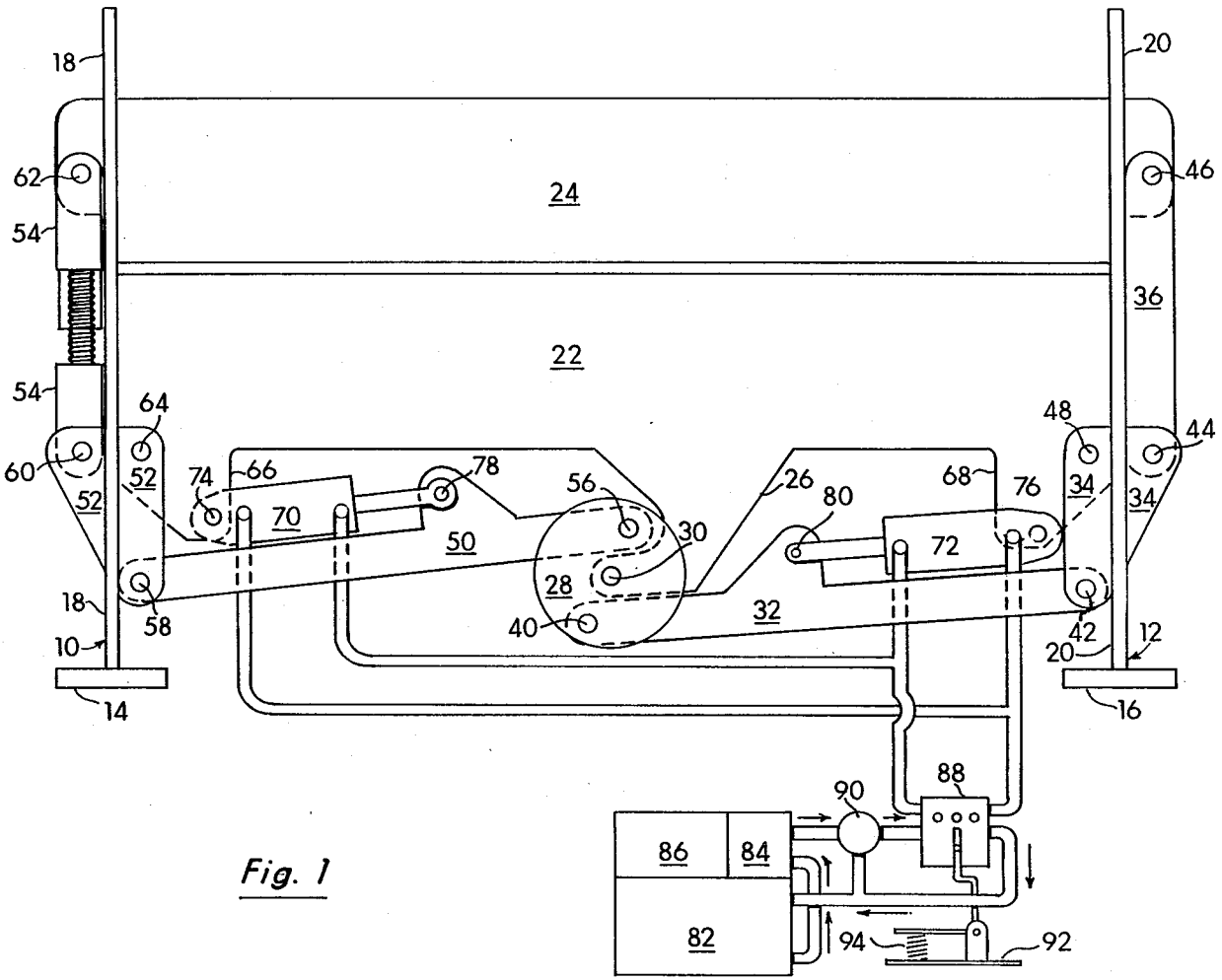
FIG. 1 is a plan view of the brake press in accordance with one embodiment of the present invention, including a schematic diagram of the hydraulic actuation system.

There is shown in FIG. 1 a press brake in accordance with a preferred embodiment of the present invention.

The press brake includes a pair of upstanding mounting supports 10, 12, each having a base 14, 16 and a vertically oriented arm 18, 20. A stationary bar 22 extends between the upstanding arms 18, 20, with the longitudinal ends of the stationary bar 22 being welded to the corresponding upstanding arm 18, 20. The press brake also includes a translatable bar 24, disposed immediately above and parallel to the stationary bar 22. The longitudinal ends of the translatable bar 24 extend through associated vertical slots (not shown) within the corresponding upstanding arms 18, 20. The lower lateral side edge of the translatable bar 24 is planar, and the upper lateral side edge of the stationary bar 22 is also planar and preferably co-parallel with the lower lateral side edge of the translatable bar 24.

The stationary bar 22 possesses a curved finger 26 depending centrally from the bottom edge thereof. A disk 28 is rotatably mounted on the tip of the finger 26 by means of a pin 30 extending through the tip of the finger 26 and centrally through the disk 28.

The disk 28 is interconnected to one longitudinal end of the translatable bar 24 through a first power bar 32, a first triangularly shaped swivel plate 34, and a connecting bar 36. The first power bar 32 is rotatably connected to the disk 28 by means of a pin 40 extending through one end of the first power bar 32 and through the disk 28. The first power bar 32 is rotatably connected to the first swivel plate 34 by means of a pin 42 extending through the other longitudinal end of the first power bar 32 and through one of the corners of the first swivel plate 34. The connecting bar 36 is rotatably connected to the swivel plate 34 by means of a pin 44 extending through one longitudinal end of the connecting bar 36 and through one corner of the first swivel piece 34. The connecting bar 36 is rotatably connected to one longitudinal end of the translatable bar 24 by means of a pin 46 extending through the other longitudinal end of the connecting bar 36 and through the associated longitudinal end of the translatable bar 24. The first swivel plate is rotatably connected to the stationary bar 22 by means of a pin 48 extending through the third corner of the swivel plate 34 and through the stationary bar 22.

The disk 28 is interconnected to the other longitudinal end of the translatable bar 24 by means of a second power bar 50, a second triangularly shaped swivel plate 52, and a turnbuckle 54. The second power bar 50 is rotatably connected to the disk 28 by means of a pin 56 extending through one longitudinal end of the power bar 50 and through the disk 28. The second power bar 50 is rotatably connected to the swivel plate 52 by means of a pin 58 extending through the other longitudinal end of the second power bar 50 and through one corner of the second swivel plate 52. The turnbuckle 54 is rotatably connected to the second swivel plate 52 by means of a pin 60 extending through one longitudinal end of the turnbuckle 54 and through one corner of the second swivel plate 52. The turnbuckle 54 is rotatably connecting to the other longitudinal end of the translatable bar 24 by means of a pin 62 extending through the other longitudinal end of the turnbuckle 54 and through the other longitudinal end of the translatable bar 24. The second swivel plate 52 is rotatably connected to the stationary bar 22 by means of a pin 64 extending through the third corner of the second swivel piece 52 and through the stationary bar 22.

The pins 40 and 56 extending through the disk 28 are preferably disposed 180 degrees apart, an equal distance away from the center of the disk 28, and near the peripheral edge of the disk 28. It will be appreciated by contemplating FIG. 1 that by rotating the disk 22 in one direction, the translatable bar 24 is moved upwardly and away from the stationary bar 22, and that by rotating the disk 28 in the opposite direction, the translatable bar 24 is moved downwardly and toward the stationary bar 22. It should be further appreciated that the longitudinal ends of the translatable bar 24 will move equal distances, thereby insuring that the translatable bar 24 does not tilt during its movement toward or away from the stationary bar 22.

As previously stated, it is preferred that the lower lateral side edge of the translatable bar 24 be maintained in a parallel position with respect to the upper lateral side edge of the stationary bar 22. In order to adjust the angle of the lower lateral side edge of the translatable bar 24 with respect to the upper lateral side edge of the stationary bar 22, the turnbuckle may be rotated in a well-known manner to adjust the length of the turnbuckle 54. Thus, the angle between the respective lateral side edges may be adjusted to any desired degree, including a parallel relation. This selected angle will be maintained during the entire movement of the translatable bar 24 with respect to the stationary bar 22.

Each longitudinal end of the stationary bar 22 is provided with a depending flange 66, 68. The press brake further includes a pair of hydraulic rams 70, 72 each including a hydraulic cylinder, piston, and rod, in a well-known construction and operation. One end of each hydraulic ram 70, 72 is rotatably connected to a corresponding flange 66, 68, by means of a pin 74, 76, respectively. The other end of each hydraulic ram 70, 72 is rotatably connected to an associated power bar 50, 32 by means of a pin 78, 80, respectively. It will be appreciated from contemplating FIG. 1 that when the rod of each hydraulic ram is extended, then the translatable bar 24 will move toward the stationary bar 22, and when the rod of each hydraulic ram 70, 72 is retracted, then the translatable bar 24 will move away from the stationary bar 22. Only a single hydraulic ram need be used to operate the press brake in the desired manner, however, the provision of two hydraulic rams insures that the system will function effectively even though one hydraulic ram might be inoperative.

The hydraulic actuation system for the hydraulic ram 70, 72 includes a tank 82 containing a reservoir of hydraulic fluid and a pump 84 powered by a motor 86 for delivering hydraulic fluid from the tank 82 under pressure to a three-way hydraulic valve 88. A variable relief valve 90 is interposed between the pump 84 and the three-way valve 88 and dumps the hydraulic fluid back into the tank 82 if the pressure of the hydraulic fluid exceeds a predetermined value.

If the three-way valve is in a first position, then hydraulic fluid is delivered under pressure to one end of the cylinder of each hydraulic ram 70, 72, thereby causing the associated rod to be extended and forcefully move the translatable bar 24 toward the stationary bar 22. If the three-way valve is in a second position (a neutral position) then the hydraulic fluid is simply dumped back into the tank 82, and the rod of each associated hydraulic ram 70, 72 does not move, thereby maintaining the translatable bar 24 in a stationary position. If the three-way valve is in a third position, then hydraulic fluid is delivered under pressure to the other side of the cylinder of each hydraulic ram 70, 72 so that the associated rod is retracted, thereby moving the translatable bar 24 upwardly, away from the stationary bar 22. The three-way valve may be operated by a foot pedal 92 so that when the foot pedal 92 is in a depressed position, the translatable bar 24 moves toward the stationary bar 22, when the foot pedal 92 is in a horizontal position, then the translatable bar 24 remains stationary, and when the foot pedal 92 is in an upwardly inclined position, then the translatable bar 24 moves away from the stationary bar 22. A compression spring 94 may be mounted beneath the foot pedal 92 so as to bias the foot pedal in an upward position, thereby insuring that when the foot pedal is not subjected to any depressing force by an operator, the translatable bar 24 will be moved upwardly, away from the stationary bar 22.

Although particular embodiments of the present invention have been described and illustrated herein, it should be recognized that modifications and variations may readily occur to those skilled in the art and that such modifications and variations may be made without departing from the spirit and scope of my invention. Consequently, my invention as claimed below may be practiced otherwise than as specifically described above.

I claim:

1. A press brake comprising:

a stationary bar having a first longitudinal end and a second longitudinal end and having a lateral side edge;

a translatable bar having a first longitudinal end and a second longitudinal end and having a lateral side edge facing said stationary bar lateral edge;

means for selectively adjusting the angle of said stationary bar lateral edge relative to said translatable bar lateral edge such that said lateral edges may be selectively oriented at a selected angle, including parallel, with respect to each other and for maintaining said selected angle when said translatable bar is translated toward or away from said stationary bar; and means for selectively translating said translatable bar toward or away from said stationary bar, said translating means including a disk rotatable about a fixed, stationary axis, a first set of linkage interconnecting one longitudinal end of said translatable bar with said disk, and a second set of linkage interconnecting the other longitudinal end of said translatable bar with said disk, the rotation of said disk in a first direction acting through both said sets of linkage to translate said translatable bar toward said stationary bar, and the rotation of said disk in a second direction acting through both said sets of linkage to translate said translatable bar away from said stationary bar.

2. A press brake according to claim 1 further comprising means for controlling said translating means, said control means capable of assuming either a first condition, a second condition, or a third condition, said control means causing said translatable bar to translate toward said stationary bar when said control means assumes said first condition, causing said translatable bar to translate away from said stationary bar when said control means assumes said second condition, and causing said translatable bar to remain stationary and neither move toward nor away from said stationary bar when said control means assumes said third condition.

3. A press brake according to claim 2 wherein said control means further includes means for biasing said control means into said second condition and further includes a foot operated pedal, the condition of said control means being responsive to the position of said pedal.

4. A press brake according to claim 1 wherein said angle adjusting and maintaining means includes means for selectively adjusting the effective length of at least one of said sets of linkage.

5. A press brake according to claim 4 wherein said length adjusting means includes a turnbuckle.

6. A press brake according to claim 4 wherein said control means includes means for selectively rotating said disk in either said first direction or said second direction of rotation.

7. A press brake according to claim 6 wherein said selective rotating means includes at least one hydraulic ram assembly.

8. A press brake comprising:

a stationary bar having a first longitudinal end and a second longitudinal end and having a lateral side edge;

a translatable bar having a first longitudinal end and a second longitudinal end and having a lateral side edge facing said stationary bar lateral edge;

means for selectively adjusting the angle of said stationary bar lateral edge relative to said translatable bar lateral edge such that said lateral edges may be selectively oriented at a selected angle, including parallel, with respect to each other and for maintaining said selected angle when said translatable bar is translated toward or away from said stationary bar;

means for selectively translating said translatable bar toward or away from said stationary bar, said selective translating means including a disk rotatable about a fixed, stationary axis, a first set of linkage interconnecting one longitudinal end of said translatable bar with said disk, and a second set of linkage interconnecting the other longitudinal end of said translatable bar with said disk, the rotation of said disk in a first direction acts through both said sets of linkage to translate said translatable bar toward said stationary bar, and the rotation of said disk in a second direction acts through both said sets of linkage to translate said translatable bar away from said stationary bar; and means for controlling said translating means, said control means capable of assuming either a first condition or a second condition, said control means causing said translating bar to translate toward said stationary bar when said control means assumes said first condition and causing said translating bar to translate away from said stationary bar when said control means assumes said second condition.

9. A press brake according to claim 8 wherein said control means is capable of assuming a third condition, said control means causing said translating bar to remain stationary and neither move toward nor away from said stationary bar when said control means assumes said third condition.

10. A press brake according to claim 9 wherein said control means further includes a foot operated pedal, the condition of said control means being responsive to the position of said pedal.

11. A press brake according to claim 8 wherein said control means includes means for biasing said control means into said second position.

12. A press brake according to claim 8 wherein said angle adjusting and maintaining means includes means for selectively adjusting the effective length of at least one of said sets of linkage.

13. A press brake according to claim 12 wherein said length adjusting means includes a turnbuckle.

14. A press brake according to claim 8 wherein said control means includes means for selectively rotating said disk in either said first direction or said second direction of rotation.

15. A press brake according to claim 14 wherein said selective rotating means includes at least one hydraulic ram assembly.

* * * * *